United States Patent [19]

Willoughby et al.

[11] Patent Number: 4,943,885

[45] Date of Patent: Jul. 24, 1990

[54] REMOTELY ACTIVATED, NONOBVIOUS PRISONER CONTROL APPARATUS

[76] Inventors: Brian D. Willoughby, 7407 Berkshire Dr., Clinton, Md. 20735; Carl W. Roy, II, 9655 Ridgeview Dr., Owings, Md. 20736

[21] Appl. No.: 155,736

[22] Filed: Feb. 16, 1988

[51] Int. Cl.[5] ..... H01T 23/00

[52] U.S. Cl. ..... 361/232

[58] Field of Search ..... 128/869, 876, 387, 388, 128/419 S, 802; 119/29; 361/232; 70/15-17; 109/35

[56] References Cited

U.S. PATENT DOCUMENTS

| | | | |
|---|---|---|---|
| 424,827 | 4/1890 | Shelton | 128/388 |
| 2,800,104 | 7/1957 | Cameron et al. | 119/29 |
| 3,523,538 | 8/1970 | Shimizu | 361/232 |
| 3,803,463 | 4/1974 | Cover | 361/232 |
| 3,980,051 | 9/1976 | Fury | 119/29 |
| 3,998,209 | 12/1976 | Macvaugh | 361/232 |
| 4,089,195 | 5/1978 | Lai | 361/232 |
| 4,092,695 | 5/1978 | Henderson et al. | 361/232 |
| 4,337,496 | 6/1982 | Laird | 361/232 |
| 4,485,426 | 11/1984 | Kerls | 361/232 |

*Primary Examiner*—L. T. Hix
*Assistant Examiner*—David M. Gray
*Attorney, Agent, or Firm*—John Leonarz

[57] ABSTRACT

Restraint apparatus for prisoners is worn beneath ordinary clothing so as to be unseen by the general public, in order that the prisoner's presumption of innocence not be denigrated by public display as is the case with manacles or the like. The apparatus operates by remote activation of an effective but nonlethal impact, such as a brief electrical interference with the somatic nervous system, or discharge of a small dose of tear gas or mace into the prisoner's breathing space.

5 Claims, 3 Drawing Sheets

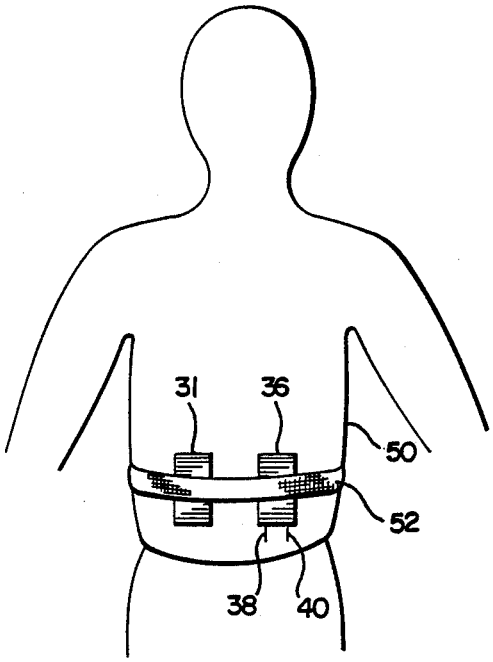
FIG 2
FIG 3
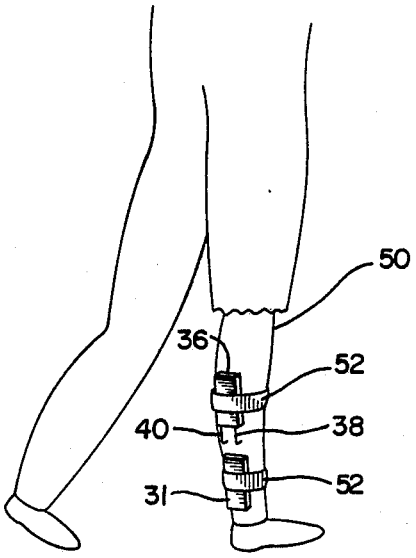
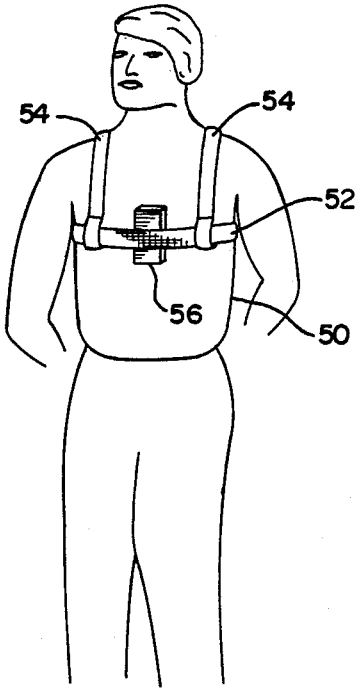
FIG 4
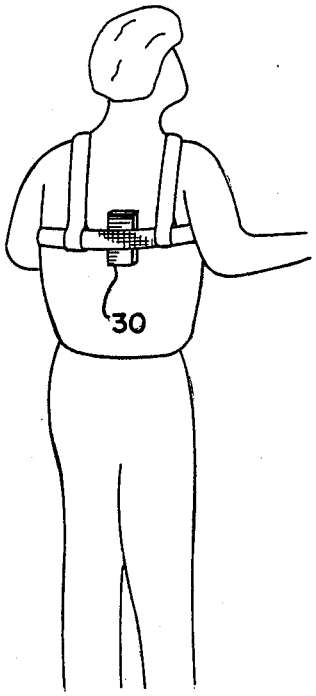
FIG 5

REMOTELY ACTIVATED, NONOBVIOUS PRISONER CONTROL APPARATUS

The present invention is addressed to the problem encountered by police and other civil authorities in providing effective means for controlling dangerous prisoners in public situations, or under other circumstances which may require such control. A significant instance of the problem lies in the provision of due process of law to accused dangerous criminals during times when the accused must appear in public for hearings, arraignments and the like. Heretofore it has often been necessary to shackle such persons to prevent them from behaving violently and becoming dangerous to themselves and others. The use of shackles, however, tends to destroy the presumption of innocence, to mark the accused as a dangerous criminal, and therefore, perhaps unconstitutionally, to discredit the accused before a jury or in dramatic news photographs showing the restraints. Therefore the authorities are reluctant to use visible restraints and are left to risk violent assaults by the accused which must be met by counter violence to frustrate his or her violent actions.

In a crowded courtroom such an incident presents great risks to all present. An emotionally aroused accused may attack the judge, witnesses or counsel, and the officer or bailiff charged with maintaining order must overpower the accused quickly before harm can be done. The very process of violently overpowering the accused, however, introduces risks of accidental injury to the the accused, the officer, or to others in the room, as a byproduct of the violence which must be applied to the accused to restrain him, or her. It is also necessary as a precaution, in order to respond quickly, that the authority figure (i.e. police officer, deputy sheriff, etc.) remain in very close proximity to the accused.

Conventional police weapons, such as pistols or clubs, presently employed as means of restraint are primarily intrinsically violent instrumentalities in themselves, dependent upon the will and relative skill of the user for the outcome of their use. Crowded public situations may contraindicate their use, or make their use extremely hazardous to persons in the vicinity. Furthermore, pistols or clubs can be taken away from those who carry them and turned toward undesirable outcomes.

Thus an especially severe instance of the problem to which the present invention is addressed lies in the potential for a prisoner to seize and threaten a hostage, sometimes with an intrinsically dangerous weapon smuggled into the scene or actually taken from a guard. In the hostage situation, the potential for overpowering the accused is at great risk to all concerned since the accused's hope of achieving an antisocial end is focused upon the prospect of immediate harm, possibly with his or her dying effort, to the hostage.

Another instance of the problem lies in the consumption of public resources which is inherent in confining large numbers of convicted prisoners to prevent their escaping and resuming antisocial activities among the public. While certain hard core prisoners probably will always have to be physically confined, many prisoners, especially those convicted of nonviolent or minor offenses, could perform a variety of work activities in public settings if the authorities and the public could be assured that the prisoners in such situations could be supervised and did not present a danger of escape or assault. If it were easier to control numbers of prisoners in such work situations, they could have increased opportunities to earn money toward support of their dependents or themselves, or toward making restitution for their crimes.

Additionally, to the extent that prisoners could be placed in effectively controlled public settings they would not be occupying prison space which is already seriously, and in many cases, unconstitutionally, overcrowded. Also, by expanding opportunities for prisoners to work and to be present among the general population while nevertheless under effective, remotely activated restraint, the process of prisoner rehabilitation and adjustment to civilian life could be greatly facilitated and their rate of recidivism reduced.

Still another aspect of the problem lies in the fact that control of prisoners under present conditions requires that guards be persons of imposing stature with robust constitutions and substantial capabilities for applying physical violence upon prisoners in their custody. These characteristics in the job descriptions of guards reduces the numbers of persons who are eligible for these positions, especially excluding large numbers of women and older workers.

DESCRIPTION OF THE PRIOR ART

The objects of the present invention do not appear to be realized by any known devices. Aside from the intrinsically dangerous personal weapons described above, conventional handcuffs, legirons or manacles appear to be the accepted contemporary means of physical restraint, and these suffer from the potential, when used in public, of denying the presumption of innocence, and hindering beneficial activities. U.S. Pat. No. 4,089,195, to Lai, for remotely radio-activated shocking manacles, appears to represent the state of the art with respect to preventing escape in public situations, but it is clear that the manacles in question would be fully visible to the public and would prevent a prisoner from accomplishing any desirable physical activities.

U.S. Pat. No. 2,800,104, to Cameron, for a Radio Controlled Electric Cutaneous Signal Type Animal Obedience Device, shows a remotely activated dog collar which activates a shock said to be useful in animal training.

Electric shocking projectiles cast out on tethers are shown in U.S. Pat. Nos. 3,523,538 and 3,803,463, respectively to Shimizu and Cover. They employ either capacitor discharge, or conductive tethers to deliver the charge to the target, and are suggested as effective means to effect an arrest of a fleeing suspect.

U.S. Pat. No. 3,980,051 to Fury, shows a range activated animal training system which employs predetermined ultrasonic phase differentials to establish a range beyond which an aversive substance is dispensed from an animal s collar if the animal strays beyond the desired range.

U.S. Pat. Nos. 3,998,209, and 4,485,426, respectively to Macvaugh and Kerls, show shock-delivering electrodes incorporated into garments, respectively turned inward (Macvaugh) to deliver a shock to the wearer when he or she snores, and outward (Kerls) to deliver a shock to a mugger who might assault the wearer.

U.S. Pat. No. 4,092,695 to Henderson, shows an electric shocking device which delivers a charge of appropriate voltage and current when repeatedly activated on contact with a person, to render the subject temporarily disabled from violent activity, but which nevertheless is thought to be free of life-threatening potential and which leaves no permanent harm nor disfigurement. When kept properly charged, the device has enjoyed a measure of success as a police tool for establishing control in situations of rowdiness and minor civil unrest. Questions about its safety and effectiveness have been investigated with reassuring results. See R. A. Stratbucker, *Safety Technical Evaluation of the Model XR* 5000 *Electronic "Stun Gun,"* Report to the Douglas County (Nebraska) Sheriff's Office, University of Nebraska Medical Center (1984).

OBJECTS OF THE INVENTION

It is an object of the present invention, therefore, to provide means for control of dangerous prisoners in public trial and other similar situations without the stigma of visible restraints so as to enable the restrained accused to appear as a normal, ordinary member of society to whom a presumption of innocence can credibly attach, without compromising the authorities' duty to assure that order will prevail in the courtroom and to provide for the safety of courtroom personnel and the general public who may be in attendance.

It is a further object of the present invention to provide means to restrain dangerous prisoners in public situations which are swiftly and consistently effective to disable such prisoners from committing assaults upon persons in their reach.

It is another object of the present invention to provide means which are effective summarily to disable a dangerous prisoner which are nevertheless not permanently harmful to the prisoner and which are not life-threatening in any way to the prisoner.

It is still another object of the present invention to provide means which can be activated by courtroom or other similar personnel to disable a dangerous prisoner whenever in their judgment the accused's behavior indicates an immediate, present danger of violence to anyone in the vicinity without simultaneously introducing dangerous potentialities for the prisoner or those who are nearby as a result of restraining counter violence undertaken by such courtroom personnel.

It is yet another object of the present invention to provide means which are not obvious or visible to the observing public, nor to the press, nor to a jury, for restraining the accused from causing disorders in the courtroom, which means are nevertheless comfortable for the accused to have in contact with his or her person, which do not interfere with the accused's ability to move about, to sit comfortably, nor in any way to prevent the accused from participating fully in his or her own defense at trial.

Another object of the present invention is to provide means for permitting prisoners to go on public work details, to move about freely within predetermined geographic limits, and to have the necessary freedom of movement requisite to accomplishing effective amounts of work in such situations, but which nevertheless assure their guards of effective means to prevent their escape or to prevent them from committing assaults on each other, their guards, or bystanders.

It is still another object of the present invention to permit remote control of individuals among a plurality of prisoners by providing means for effecting such remote control which includes sending individually coded signals which are effective to deliver a disabling impact to individual prisoners by transmitting a particularly coded signal corresponding to a particular prisoner who must be restrained without also impacting all prisoners within the group to be controlled.

It is still another object of the present invention to provide means for restraint of dangerous prisoners in public situations without visible manacles or legirons, which is nevertheless effective to disable such dangerous prisoners, and whose effectiveness is maintained at its full complement of readiness until immediately before its use.

Still another object of the present invention is to provide means for effective prisoner control which do not limit the job qualifications of guards to persons of extraordinary size and physical skills.

Another object of the present invention is to provide means for prisoner restraint which is not an intrinsically dangerous instrumentality in its own right, and which cannot easily be turned by the prisoner to undesirable ends.

Yet another object of the present invention is to provide effective means for safely preventing dangerous prisoners in public situations from effectively taking or holding hostages, while nevertheless keeping the circumstances free from the introduction of excessively violent instruments.

Still another object of the present invention is to provide means for effective control of prisoners in public transportation situations, especially during air travel which presents numerous opportunities for mischief and hostage-taking and during which conventional restraints are particularly inconvenient to use.

It is a further object of this invention to provide prisoner restraint means for use in public transportation situations which do not infringe upon the prisoner's rights to save himself in an emergency.

BRIEF DESCRIPTION OF THE INVENTION

The Remotely Activated, Nonobvious Prisoner Control Apparatus of our invention includes means for delivering an incapacitating impact to a prisoner, such as an electric shock or a disabling spray of a noxious gas such as tear gas. The means for delivering the incapacitating impact is incorporated into a secure band worn under the prisoner s clothing and fixed in place by a means which is beyond the capability of the prisoner to remove easily or quickly. Also incorporated into the secure band is a radio receiver capable of receiving at least one specific coded signal. The radio operates to initiate the delivery of the incapacitating impact either upon an affirmative signal received over the radio, or in a different mode, upon the failure of the signal to suppress the release of the incapacitating impact. The radio transmitter is held by a guard somewhere close at hand, within secure radio range. It may be a single channel (or code) device, or it may have multiple channels (or codes) to enable its use in controlling a plurality of prisoners.

A session requiring the use of our invention would begin with the prisoner(s) in conventional security status, receiving the secure band upon his or her person. The band would be fastened in place by guard personnel about the waist/midsection, or the lower leg for an electrical shock apparatus, or in an alternative version, about the chest for an incapacitating spray apparatus. Conventional street clothing would then be put on so as to cover the restraint apparatus from view. A test would be made to assure that the radio connection was working, and then the device would be armed so that a subsequent triggering message would actually release the incapacitating impact.

If the prisoner were to attempt a hostile act the incapacitating impact would be released by a radio message initiated by the guard, disabling the prisoner and permitting the guard time during the few moments of the prisoner's disability or incapacity to apply conventional restraints, such as handcuffs. If the prisoner were to obtain a weapon and seize a hostage, the incapacitating impact could still be released, immediately disabling the prisoner before the prisoner could harm the hostage, and permitting the prisoner's recapture without risking misdirection of force at the hostage.

BRIEF DESCRIPTION OF THE DRAWINGS

FIG. 2 is a view of a prisoner's back showing the receiver and electrical-impact modules of our invention secured in place.

FIG. 3 is a view of a prisoner's calf showing another electrical version of our invention in place on the prisoner's leg.

FIG. 4 is a front view of a prisoner showing a noxious gas version of our invention.

FIG. 5 is a back view of the noxious gas version of our invention shown in FIG. 4.

DESCRIPTION OF THE PREFERRED EMBODIMENT

Figure 1:
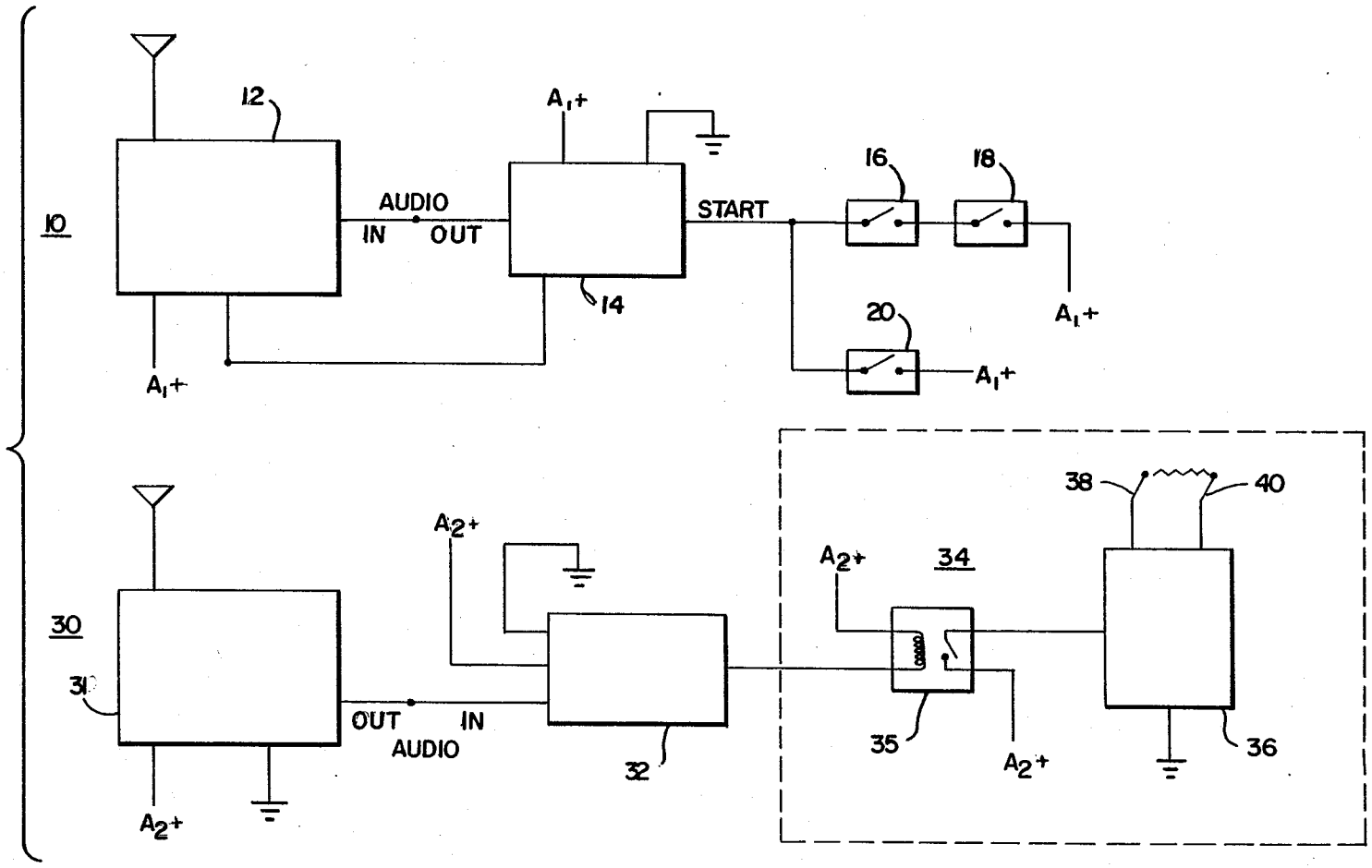
FIG. 1 is an electrical schematic diagram of the transmitting unit and of the receiver/impact unit of our invention.

In general the hardware of our invention may be thought of as including four subsystems: an incapacitating impact means, means for transmitting a coded activation signal, receiver means to receive the coded signal and activate the incapacitating impact and means of mounting the receiver-impact means effectively upon the prisoner's person.

An incapacitating impact upon the prisoner may be delivered by any of a variety of effective mechanisms which produce momentary incapacity without permanent harm. These may include electric shock, incapacitating vapors such as tear gas, or injections of anasthetics.

The preferred embodiment includes electrical means for delivery of the incapacitant. In the preferred embodiment of our invention, the incapacitant is a short series of intermittent, low-powered but high-voltage, pulsatile shocks delivered preferably from a prepackaged unit such as the electronic components of the well-known "XR-5000" stun gun, sold by the Nova Company, Austin, Tex. Our invention includes electrodes modified from the original stun gun for constant contact with the prisoner's skin, and means to generate and supply to those electrodes the shock outputs described above. These shocks feature a heavily damped sinusoid waveform with a peak-to-peak voltage of approximately 50,000 volts, and a peak current as high as 20 amperes. Ordinarily shocks of these magnitudes would be lethal, but the decay constant is only 4 microseconds and there is some 50 milliseconds between pulses. Thus, the power of the system averages only about 1.2 watts over one second.

Surprisingly little research has been found describing the detailed physiology of electrical impulses on the skin of subjects' bodies. Substantial practical experience with the XR-5000 device in police work has nevertheless fully established that it is a safe and effective device for disabling unruly persons in arrest situations when it is powered with fresh batteries. The effectiveness of the device has been seen to deteriorate when the power source is depleted, but the safety of the shock recipient is not in jeopardy under these circumstances.

The pulsatile shocks which the XR-5000 delivers appear to work by momentarily confusing the body's nervous system. It is thought that the body's somatic nervous system signals, which direct the musculo-skeletal system, are interfered with, and lacking coherence to produce normal muscular control and erect body posture, the shock recipient's nervous system experiences a brief, temporary collapse. Volunteers for such shocks describe the experience as similar to a severe slap to the skin with full recovery following with only brief delay. Police who have used the device describe the effect as the subject "folding up" or report that the subject "lost control of his legs". No side effects nor even prolonged impairment are known to have been reported in connection with the use of the device. Furthermore, those upon whom the device has been used do not report remembering any pain in connection with its use, possibly because their attention had been absorbed in concentration upon the antisocial behavior, their engagement in which, one supposes, provoked the use of the stun gun in the first place.

It is important to the use of our inv that the power supply be fresh enough to deliver a fully effective impact to the prisoner. An important criticism of the XR-5000 has focused on its reduced effectiveness when operating on partially discharged batteries. This is understood to result from the fact that as a part of an officer's regularly carried equipment, the device may be carried about, left in patrol cars or in non-charging equipment storage for substantial periods of time without replacement or recharging of the batteries. Since the occasions for use of the XR-5000 arise without notice, the device has been called upon in battery-weakened condition when it could not be as effective as when the batteries were fully-charged.

We note that the use of our invention, which is not a unit of arrest equipment, but merely of control equipment, is more easily predictable and therefore our device would not be left about in environments which would degrade the battery potential. We have devised powered storage including battery rechargers in which our devices should be kept when not in use. Thus as occasions arise for prisoner public appearances the plan for such an event would include the dismounting of the prisoner controller unit from its charging storage and its attachment to the prisoner just before his emergence from conventional custody, and when our device would be fully powered.

Those skilled in the arts of law enforcement have long known and used noxious, incapacitating gases such as mace or tear gas as a riot control tool. Tear gas has been used for these purposes in many situations and has achieved public recognition as an effective agent for riot control which does not cause permanent harm. In our invention a small dispenser of tear gas or the like, may be attached to a harness worn about the prisoner's chest and positioned so that when activated the dispenser aspirates the gas into the air in front of the prisoner's immediate facial area inducing sufficient distress as to divert the prisoner's attention from his intended mischief. The immediate incapacitating, but not permanently harmful, effect fully absorbs the attention of the prisoner to the exclusion of any misconduct which may theretofore have been his intention. While the tear gas version of our device is slightly slower to take effect than the electric shock version, it is thought important to offer it for use in jurisdictions in which the relatively humane character of the XR-5000 device is not fully accepted, where full electrical charge cannot be assumed, or for environments in which electrical discharge might be inappropriate.

As may be seen from FIG. 1, the transmitter 10 consists of a standard FM compact transceiver 12 such as the Radio Shack Model Number 21-401. The transceiver 12 is modified to deliver an encoded signal for which the code is provided by the two-tone encoder 14 such as the Model PE-2A encoder from Communications Specialists, Orange, Calif. A transmission is activated intentionally when both the push-button switches 16 and 18 are simultaneously activated. The transceiver 12, encoder 14 and associated appurtenances of the transmitter 10 are packaged together for convenience in a single unit. A separate tamper switch 20 may also be provided in case an attempt is made to defeat the prisoner control system by detaching the transmitter from the custodian's belt or mounting harness.

With further reference to FIG. 1 the receiver unit 30 which is made from a standard FM compact transceiver 31, such as Radio Shack Model 21-401, receives the encoded signal from the transmitter 10 and delivers it to the decoder 32, which is an SD-1000 Programmable Two-Tone Sequential Decoder from Communications Specialists, Inc., Orange, Calif. The output from the decoder 32 is directed to the impact unit 34, where it activates a single pole single throw relay 35 to initiate the shock unit 36, which may be the well-known shock-generating apparatus of an XR-5000 unit sold by the NOVA Company, Austin, Tex. The shock impact to the prisoner's skin is delivered through the electrodes 38 and 40.

The receiver 30 and impact device 34 may be mounted on a prisoner's person in a variety of ways as may be seen by reference to FIGS. 2–5. In FIG. 2 a prisoner 50 has a belt 52 strapped to his waist with the receiving unit 31 and the impact unit 34 mounted thereon. The shock unit 36 is placed with the electrodes 38 and 40 urged directly against the prisoner's skin. The receiving unit 30 and the impact unit 34 are preferably packaged separately but may be enclosed together in a single unit.

In FIG. 3 another version of the invention is shown, wherein the belts 52 are strapped about the leg of the prisoner 50 with the receiver 30 and impact unit 34 mounted thereon, with the electrodes 38 and 40 urged directly against the skin at the back of the prisoner's calf.

FIGS. 4 and 5 show the front and rear views respectively of a shoulder harness used for mounting a gas version of our invention. For this application, shown in FIG. 4, a belt 52 is placed about the chest of the prisoner 50, being secured by shoulder straps 54. An aspirator 56 is mounted on the belt at the prisoner's front, aimed to discharge the contents of the tear gas storage into the air in front of the prisoner upon activation. The belt 52 carries a wire connecting the aspirator 56 around the prisoner's body to the receiver unit 30, seen in FIG. 5. When activated by a signal from the transmitter unit, the receiver decodes the signal and activates a relay which releases the tear gas, thereby disabling the prisoner and ending any mischief he may have been attempting.

Another version of our invention includes range-oriented activation-suppression apparatus. In this version the output power of the transceiver 12 is adjusted by well-known, conventional means to be effective only within a predetermined distance from the transmitter.

Figure 6:
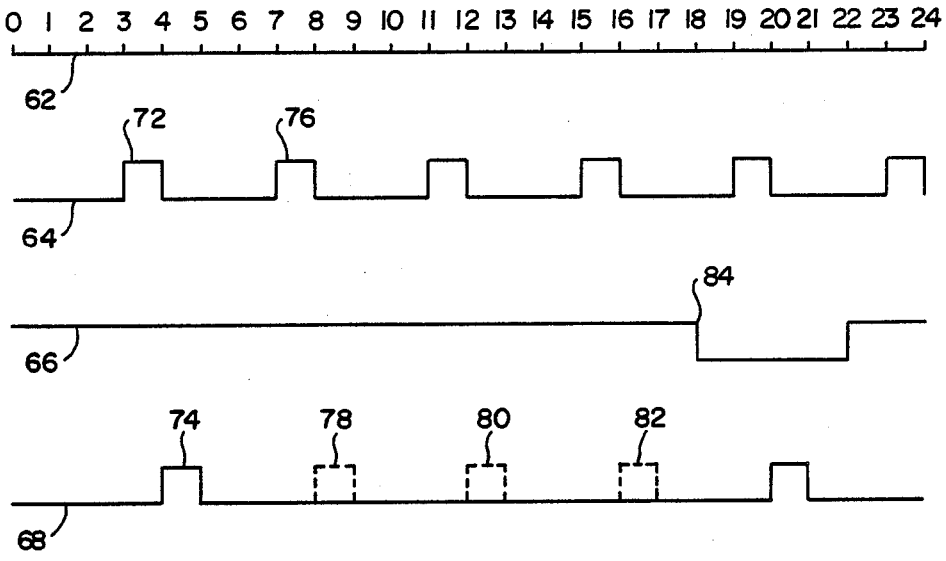
FIG. 6 is a schematic timing diagram used in a limited-distance version cf our invention.

Central to this version of our invention is the timing diagram of FIG. 6, wherein a time line 62 represents a series of equal time intervals, such as seconds. An activation-initiation signal 64 is emitted from within the impact unit at regular intervals. The initiation signal 64 activates a delay timer represented by the signal 66 which begins a count with each initiation signal. The count is interrupted by a transmitted reset signal 68 which puts the count back to zero. Thus a count is begun by the initiation signal 72, but is interrupted by the reset signal 74. Another initiation signal 76 starts the count again but the reset signal 78, shown as a dashed line, is interfered with, as by the prisoner having gone beyond the zone of signal strength. The counter is not reset. Additional reset signals 80 and 82 are also ineffective to reset the timer 66 and the impact is then activated when the timer signal goes low (84).

In the hardware realization of FIG. 6, the transmitter 10 is modified to include timed switching means such as a 555 timer IC, adapted to emit a signal at a periodic interval. To work cooperatively with the adjusted power transmitter 10, the impact unit 34 is modified by inserting, between the relay 35 or similar device and the shock unit 36, a counter circuit (such as a number 7490 IC) working according to the scheme diagrammed in FIG. 6, to reset upon receipt of a signal from the transmitter 10. The counter circuit is adjusted to activate the shock unit on the count of triple the transmission interval plus one count in order to allow at least three chances to reset the counter before activation. In this way a signal lost due to a momentary interference would not result in unnecessarily disabling the wearer of the shock unit. The counter circuit can be adjusted to vary the number of interval multiples several times to further reduce the likelihood of unintended activation, while increasing the "free" interval to the prisoner. If the wearer attempts to escape by increasing the distance from the bearer of the transmitter, the signal weakness eventually fails to reset the counter circuit, whereupon activation of the shock unit would not be suppressed and the wearer would be disabled from continuing the escape attempt. It should be noted that this method cannot be defeated by an attempt to block the signal from the transmitter.

It will be obvious to those skilled in the art that in the light of the foregoing specification many variations upon this scheme may be made to achieve the primary objectives of our invention. It is our intention to claim all the variations to which our invention entitles us.

We claim:

1. Apparatus for control of a dangerous prisoner to prevent unpredictable dangerous actions by said dangerous prisoner while in social context situations while nevertheless concealing such apparatus from public view, comprising:

incapacitant delivery means, torso mounting means comprising a belt of sufficient extent to encircle a prisoner's torso and means for securing said incapacitant delivery means in contact with said prisoner's torso, said mounting means being adapted for concealment beneath garments ordinarily worn by ordinary persons in said social context to prevent said prisoner from being marked by observers in said social context as a person under restraint, said incapacitant delivery means being powered to deliver an incapacitating electrical shock to said prisoner, said mounting means further including means for receiving a remotely activated signal, and means in said mounting means responsive to said signal for delivering said incapacitating electrical shock to said prisoner.

2. The apparatus of claim 1 wherein said signal includes a predetermined code corresponding to a particular prisoner, for selectively identifying and distinguishing a particular signal from other signals, said apparatus being responsive for activation exclusively through means in said receiving means for selectively identifying and distinguishing said particular signal according to said predetermined code, for limiting impact of said apparatus to said particular prisoner.

3. The restraint apparatus of claim 1 wherein an incapacitant to be delivered includes nonlethal electric shocking means characterized by pulsatile, high-voltage, low-powered, short-duration electric shock outputs.

4. Nonobvious prisoner control apparatus for operation by a controlling authority located remotely from a prisoner, while said prisoner is in clothing both appropriate to a public situation, and permitting normal functions of movement by said prisoner comprising:

means concealable beneath said appropriate clothing of said prisoner to, be controlled, securely banded around said prisoner s torso, for delivery of a nonlethal disabling electrical impulse to said prisoner, means connected to said electrical impulse delivery means for receiving a signal, including means for activating said electrical impulse delivery means upon receipt of said signal, and means, operable by said controlling authority, for generating and transmitting said signal for activating said electrical impulse delivery means to disable said prisoner.

5. Range-oriented prisoner control apparatus for operation remote from a prisoner, comprising:

means for delivery of a nonlethal disabling electrical impulse to the skin of a prisoner to be controlled, means connected to said electrical impulse delivery means for receiving a signal, including means for activating said electrical impulse delivery means upon nonreceipt of said signal, and means for generating and transmitting said signal within only a predetermined distance, for preventing activating said electrical impulse delivery means to disable said prisoner.

* * * * *